United States Patent [19]

Ruebesam

[11] Patent Number: 4,955,495

[45] Date of Patent: Sep. 11, 1990

[54] HAZARDOUS WASTE CONTAINER WITH INTEGRAL HOLD-DOWN MECHANISM

[76] Inventor: George B. Ruebesam, Rte. 1, Box 29, Readsboro, Vt. 05350

[21] Appl. No.: 476,884

[22] Filed: Feb. 8, 1990

[51] Int. Cl.[5] ..... B65D 21/00

[52] U.S. Cl. ..... 220/545; 220/22.3; 220/93

[58] Field of Search ..... 220/1.5, 1 T, 22.3, 220/22.5, 85 R, 93; 100/912, 56

[56] References Cited

U.S. PATENT DOCUMENTS

| | | | |
|---|---|---|---|
| 612,926 | 10/1898 | Harris | 220/93 |
| 2,392,604 | 1/1946 | Mallory | 220/93 |
| 2,970,533 | 2/1961 | Allen | 220/93 X |
| 3,869,979 | 3/1975 | Sulcek | 220/1 T X |
| 4,436,215 | 3/1984 | Kleinert et al. | 220/22.3 |
| 4,658,720 | 4/1987 | Massonnet | 220/1 T X |
| 4,838,445 | 6/1989 | Lanius | 220/22.3 |

*Primary Examiner*—Steven M. Pollard

*Attorney, Agent, or Firm*—Mason, Fenwick & Lawrence

[57] ABSTRACT

A container, intended for use in the disposal of hazardous waste, is provided with pairs of opposed locking rails which are attached to the interior faces of the side walls and project into the container. Extending between each pair of opposed locking rails are pairs of hold-down bars which have resilient arms biased towards one another to engage ratchet bars formed in the locking rails. The ratchet bars allow for downward motion of the hold-down bars, but do not allow for upward motion. Racks are placed between the waste material to be compacted and each pair of hold-down bars to increase the compression maintaining capabilities of the hold-down mechanism. The hold-down bars prevent expansion of the waste material through their engagement with the locking rails. Several pairs of hold-down bars and racks can be used in each container. A lid for the container is designed to be attached tightly to the container with clips which grip openings on the container walls. Optional supports can be connected to the container bottom with detachable clips to enable easy forklift transport.

10 Claims, 3 Drawing Sheets

HAZARDOUS WASTE CONTAINER WITH INTEGRAL HOLD-DOWN MECHANISM

FIELD OF THE INVENTION

This invention is in the field of waste containers and is more specifically directed to a hazardous waste container used with trash compactors for compacting low-level radioactive wastes from nuclear power plants.

BACKGROUND OF THE INVENTION

Disposal of hazardous waste, such as waste generated by a nuclear power plant, requires special procedures and containers. An effective way to dispose of such materials involves the compaction of the hazardous waste with a compactor capable of compressing the materials without any discharge of dust or other light-weight portions of the materials into the atmosphere. Such a compactor and method of compaction is described in my U.S. Pat. No. 4,273,037, which is specifically incorporated herein by reference in its entirety as if reproduced in full.

Due to the large amounts of hazardous waste materials which need to be disposed of, it is desirable to compact this waste into as small a space as possible; this requires that high pressures be exerted upon the waste in order to compact it in sealed waste disposal containers. Generally, these containers must meet standards set forth in Title 49 of the Code of Federal Regulations and/or any other requirements imposed by the particular use or customer. However, these containers suffer from two problems; at high pressures, the walls of the waste containers tend to buckle outward or collapse, and expansion of compressed material inside of the containers tends to make it hard to seal or fill them to their optimal capacity.

The prior art attempted to solve these problems with special containers such as the one illustrated in FIGS. 1, 2 and 3. Prior art waste container 10 utilizes a plurality of parallel steel hold-down rods 12 to help compress and maintain compression upon waste compacted in the container. The prior art hold-down rods 12 comprise a main rod 14 with flanges 16 on both ends. Flanges 16 engage opposed locking devices 18 attached to the inside faces 20 of opposed container side walls 22. With particular reference to FIGS. 2 and 3, it can be seen that each of the locking devices 18 are formed from a left track 24 and a right track 26. Tracks 24 and 26 are mirror images of each other and comprise connecting strips 28 connected to the inside faces 20 of side walls 22, projecting strips 30 extending perpendicularly from connecting strips 28, and retaining strips 32 extending perpendicularly from connecting strips 28. Downward sloping tabs 34 are formed in each of retaining strips 32 by punching out holes 36. Tabs 34 ar bent towards inside faces 20 of side walls 22.

In use, main rods 14 are slidably engaged between tracks 24 and 26 while flanges 16 on main rod 14 are inserted between retaining strips 32 and inside faces 20. Flanges 16 are pressed against the tops 40 of downward sloping tabs 34. As hold-down rods 12 are guided down locking devices 18, flanges 16 press against tops 40 of tabs 34 to bend them towards inner walls 32*a* of retaining strips 32; ideally, tabs 34 rebound towards inside faces 20 of side walls 22 after the flanges 16 no longer press against them. Flanges 16 also strengthen side walls 22 of the container 10 by pressing against inner walls 32*a* of retaining strips 32.

The purpose of tabs 34 is to allow downward motion of the flanges 16 in locking devices 18, but to prevent upward motion of flanges 16. In order for tabs 34 to work correctly, they have to be resilient enough to bend downward in locking devices 18 when flanges 16 are pressed down against them, and they must be strong enough to maintain their angle of projection towards side walls 22 when upward pressure is exerted against them by flanges 16 so as to prevent upward motion of hold-down rods 12.

However, tabs 34 tend to break off when high compaction pressures are used; this allows hold-down rods 12 to move upward as compressed waste expands. Furthermore, the design of the locking devices 18 uses up the space between tracks 24 and 26 which could be used for compacted waste, and locking devices 18 do not sufficiently add to the strength of side walls 22.

There is thus a need for a waste disposal container with an integral hold-down mechanism which can withstand high compaction pressures without breaking, can contribute to the strength of the container walls, and which uses up a minimum of space. It is the solution to these and other problems to which the present invention is directed.

SUMMARY OF THE INVENTION

Therefore, it is a primary object of this invention to provide a new and improved container for use in compacting and storing waste.

A further object of the present invention is to provide a hold-down mechanism in a waste container which utilizes a minimum of space.

It is yet another object of the present invention to provide a waste container with a hold-down mechanism which compresses and maintains the compression on waste in the container and which also increases the strength of the container walls against buckling.

It is still yet another object of the present invention to provide a waste compaction and storage container which utilizes a hold-down mechanism which operates without interference from the waste therein.

These and other objects of the invention are achieved by the provision of a container having a bottom panel with two opposed side walls and two opposed end walls projecting upwards from the edges of the bottom panel. Pairs of opposed locking rails extend vertically along the opposed inner faces of the container side walls, and project into the container interior. A hold-down bar extends between each set of opposed locking rails with pairs of opposed resilient pawls or arms projecting from both ends of the hold-down bar to engage the locking rails.

Each locking rail comprises a central beam that is connected at one side to the inner face of a side wall of the container and which terminates in a ratchet bar having a plurality of teeth. The teeth are arranged so that the distal ends of the hold-down bar arms fit loosely about necked-in portions between adjacent pairs of teeth. The ratchet bars are designed so that downward pressure on the hold-down bar against the wedge-shaped upper edges on the pairs of teeth flexes the distal ends of the arms away from the hold-down bar and allows the arms to slide downward along the ratchet bar until upward pressure equals downward pressure. Upon release of the downward pressure, expansion of waste compressed beneath the hold-down bar forces the arms to slide upward until the next highest pair of teeth are reached along the ratchet bar; further upward motion is stopped by the bottom edges of the pair of teeth immediately above the necked-in portion engaged.

Clamps are attached on the inner surface of the distal ends of each of the hold-down bar arms to engage the back face of the locking rail ratchet bars to provide strength to the container walls. A guard plate is attached adjacent to each pair of opposed resilient arms on the hold-down bar to prevent the entrance of waste material between the arms and the hold-down bar.

Other objects and advantages of the subject invention will become apparent from the accompanying drawings and detailed description in which like reference numerals are used for the same parts as illustrated in the various figures.

DETAILED DESCRIPTION OF THE INVENTION

Figures 4, 5, 6:
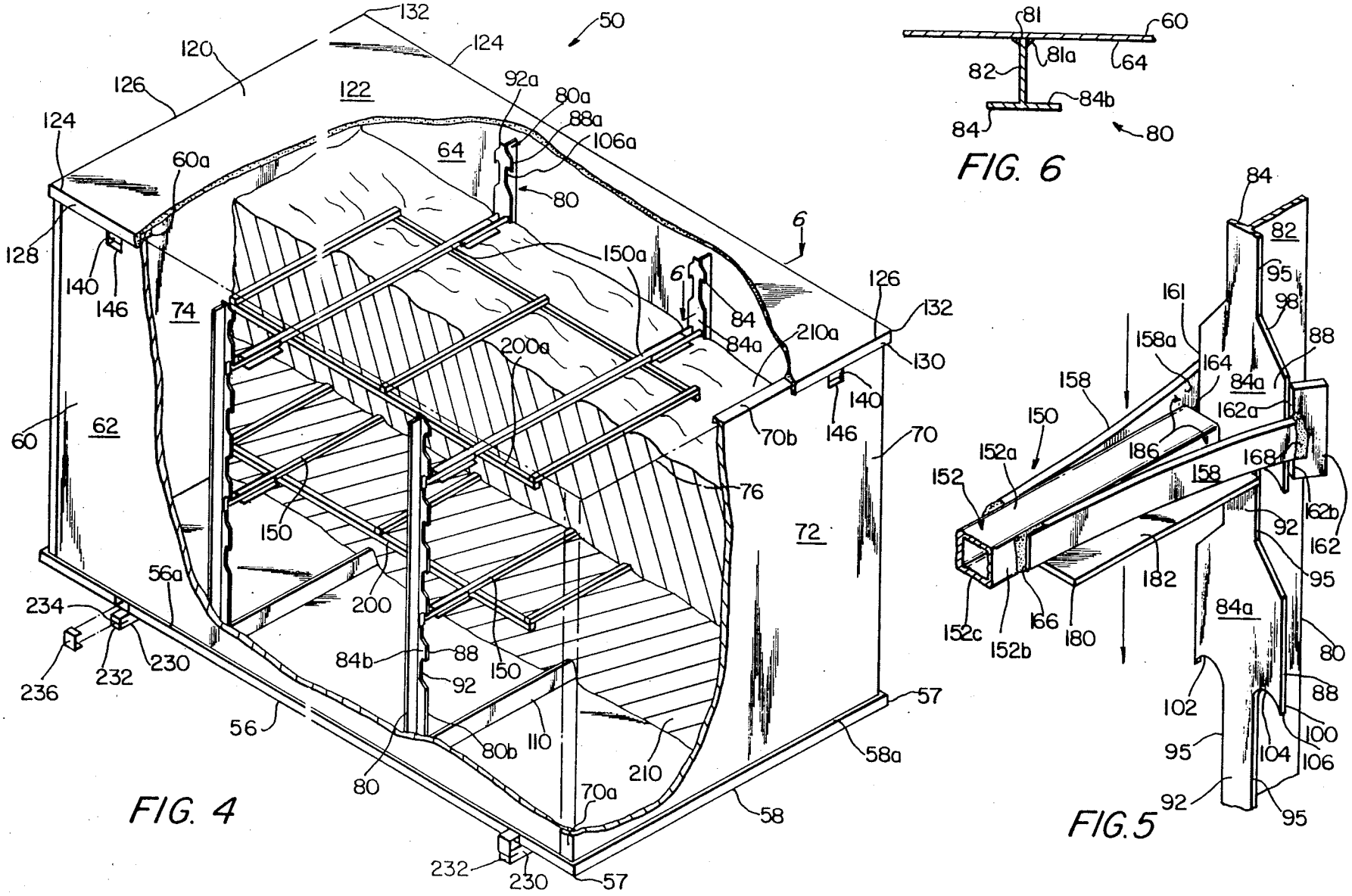
FIG. 4 is a perspective view of the container of the present invention holding compacted waste material with a portion of the lid and container walls being cut away to reveal the components contained within.
FIG. 5 is a partial, perspective view of the hold down bar of the present invention in engagement with the locking rail of the present invention.
FIG. 6 is a sectional view of the locking rail of the present invention taken along lines 6—6 of FIG. 4.

FIG. 4 illustrates the hazardous waste container 50 of the present invention. The container 50 is formed from a rectangular bottom panel 54 having side edges 56 and end edges 58. In a preferred embodiment, the bottom panel 54 is formed from a rectangular sheet of steel in which notches are cut in all four corners, resulting in a rectangular center sheet with projecting flanges on all edges. These flanges are then bent upwards perpendicular to the center sheet to form opposed vertical side an end flanges **56*a* and 58*a*. Flanges 56*a* and 58*a* meet to form corners 57 where they can be welded together. Extending upwards from side edges 56 on bottom panel 54, inwardly of side flanges 56*a*, are two opposed side panels 60. Side panels 60 are essentially rectangular in shape, and in a preferred embodiment are made from steel with two notches cut at the two upper corners to produce a flange 60*a*** which is bent perpendicularly inward towards the other side panel.

Extending upwards from end edges 58 of bottom panel 54 are two opposed end panels 70. In a preferred mode, end panels 70 are also made of steel and have notches cut in all four corners; this likewise results in a rectangular center sheet having flanges projecting from all four edges. The two side flanges **70*a* are bent perpendicular to the center sheet so that they overlap the outer face 62 of side panels 60, and the upper flange 70*b* is bent perpendicular to the central sheet to contact the upper flanges 60*a* of side panels 60 to form a lip 76 about the inner perimeter of the top of container 50**.

Locking rails 80 ar connected to the inner faces 64 of side panels 60. Referring now to FIG. 5 and FIG. 6, the structure and function of locking rails 80 are described in greater detail. Each of locking rails 80 is substantially T-shaped in transverse cross-section, comprising a longitudinal center beam 82 and a longitudinal ratchet bar 84 perpendicular thereto. The center beams 82 of locking rails 80 are attached at back edges 81 with welds **81*a* to inner faces 64 of side panels 60; in a preferred embodiment, beams 82 extend perpendicularly from inner faces 64 and are essentially vertical. Ratchet bars 84 are provided with a plurality of alternating pairs of teeth 88 and necked-in portions 92 which define discrete stopping positions along ratchet bars 84** for a purpose to be described hereinafter.

Necked-in portions 92 have outer edges 95, which are substantially parallel to center beams 82 in a preferred embodiment. Teeth 88 have upper edges 98 which meet edges 95 of necked-in portions 92 located above each pair of teeth 88; upper edges 98 slope downward from edges 95 of necked-in portions 92 to form a wedge shape at upper edges 98 of each pair of teeth 88 for a purpose to be described hereinafter. Upper edges 98 terminate at side edges 100, which are substantially parallel to center beam 82 in a preferred embodiment. Side edges 100 terminate in lower edges 102 which slope upwards towards necked-in portions 92 located below each pair of teeth 88. In a preferred embodiment, lower edges 102 are shaped to provide curved indentations 104 which meet necked-in portions 92 below each pair of teeth 88; there is thus a gradual curved transition from edges 95 of necked-in portions 92 to lower edges 102 of teeth 88. A downward facing projection 106 is formed by the confluence of curved lower edges 102 and side edges 100; indentations 104 and projections 106 are provided in a preferred embodiment for a purpose to be described later.

In a preferred embodiment, ratchet bars 84 are of unitary constructions so that teeth 88 and necked-in portions 92 are integrally connected to present a planar front face **84*a* and a planar back face 84*b***.

In a preferred embodiment, a pair of rectangular planar ribs 110 extend between front faces **84*a* of ratchet bars 84 of opposed locking rails 80 and along the bottom panel 54. Ribs 110 are extensions of center beams 82 of locking rails 80, in that they extend from and are co-planar with center beams 82**.

Container 50 preferably is assembled by placing the bottom panel 54 on a flat surface such as a floor, standing an end panel 70 on bottom panel 54 near an end edge 58, and tacking end panel 70 to bottom panel 54. This procedure can be followed for the other end panel 70 and for the two side panels 60. A small weld can then be placed near the top of the seam where end panels 70 meet side panels 60. Ribs 110 can then be welded to bottom panel 54 and to front faces **84*a* of opposed locking rails 80 which have been previously attached to the inner faces 64 of side panels 60. A continuous weld can then be placed along the vertical seams between side panels 60 and end panels 70. Following the welding of side panels 60 to end panels 70, container 50 can be flipped on its side, and continuous welds placed along the seams between end panels 70 and bottom panel 54. The box can then be turned on an end, and two continuous welds placed along the seams between side panels 60 and bottom panel 54**.

A lid 120 is formed from a rectangular panel 122 having side edges 124 and end edges 126. In a preferred embodiment, lid 120 has a length and width approximately one-half inch greater than the length and width of bottom panel 54, and is formed from a rectangular steel sheet with all four corners notched to form side flanges 128 and end flanges 130; flanges 128 and 130 project from side edges 124 and end edges 126 of panel 122, respectively. Flanges 128 and 130 are bent perpendicularly downward from panel 122 to form a continuous flange about the perimeter of panel 122 with Corners 132 welded together to join end flanges 130 With side flanges 128.

Figure 2:
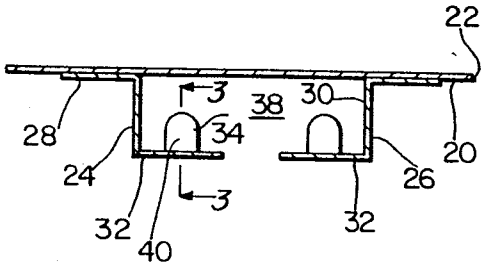
FIG. 2 PRIOR ART
FIG. 2 is a sectional view of the prior art container locking device taken along lines 2—2 of FIG. 1.
Figure 3:
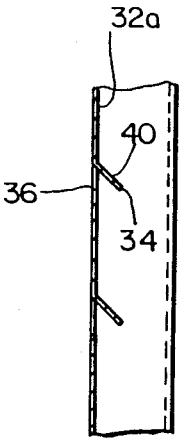
FIG. 3 PRIOR ART
FIG. 3 is a sectional view of the prior art locking device taken along lines 3—3 of FIG. 2.
Figure 1:
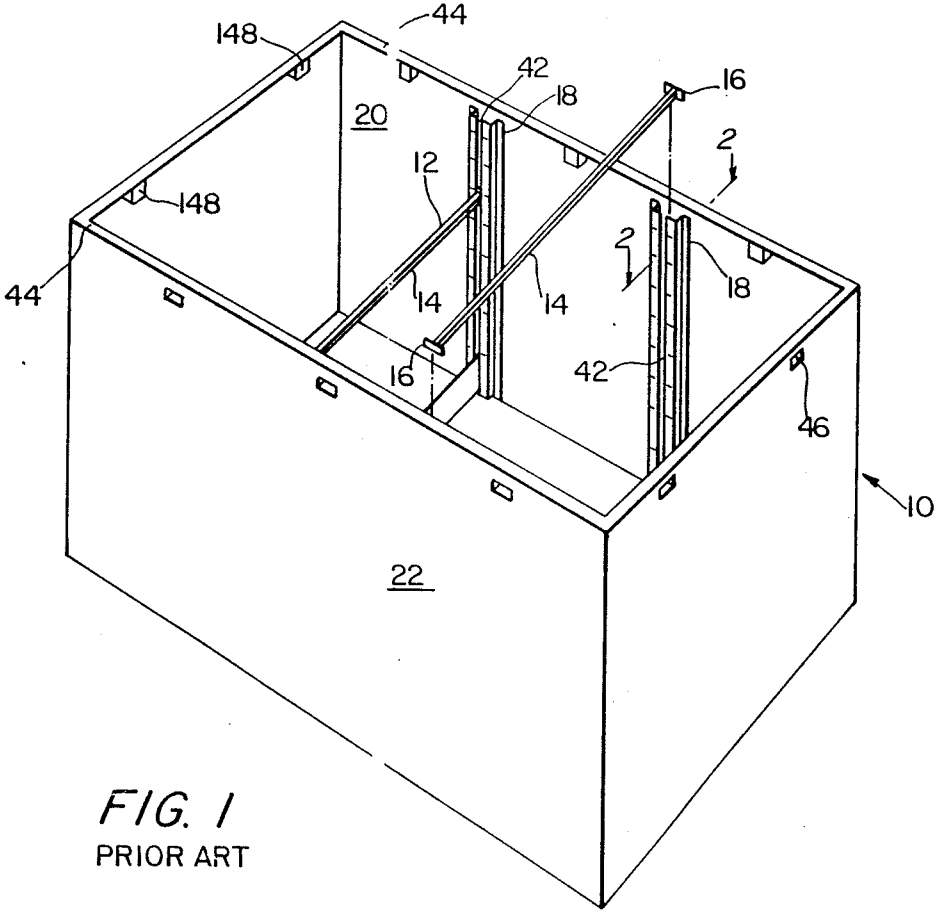
FIG. 1 PRIOR ART
FIG. 1 is a perspective , partially-exploded view of the prior art container.

Extending downward from side edges 124 and end edges 126 of lid 120 are conventional cover clips 140. Clips 140 are bent into openings 146 formed near the top edges of the outer faces 62 of side panels 60 and the outer faces 72 of end panels 70. As shown with respect to the prior art container illustrated in FIG. 1, covers 148 can be used to prevent the entrance or exit of air or other material through openings 146 into the container. Covers 148 can be prismatic in shape, and can be welded about openings 146 and to the lower surface of container lip 76. In a preferred mode, covers 148 are made from steel, and provide sufficient room for clips 140 to be inserted therein and bent upwards to firmly grip lid !20 to container 50. A seal (not shown) can also be located between lid 120 and the top edges of side panels 60 and end panels 70.

In a preferred embodiment, locking rails 80 are made from two inch by one quarter inch (2"×¼") hot rolled ASTM A36 steel bars, with the side edge of one bar connected to the center face of the other bar to form a "T". Thus, center beam 82 of a preferred locking rail 80 would be two inches (2") wide, and terminate with one inch (") perpendicular flanges having teeth 88 and necked-in portions 92 cut therein to form ratchet bars 84. Preformed "T's," when available, can also be used. It is important that the material used for the locking rails 80 have a high strength and that any steel used be easily welded.

Figure 7:
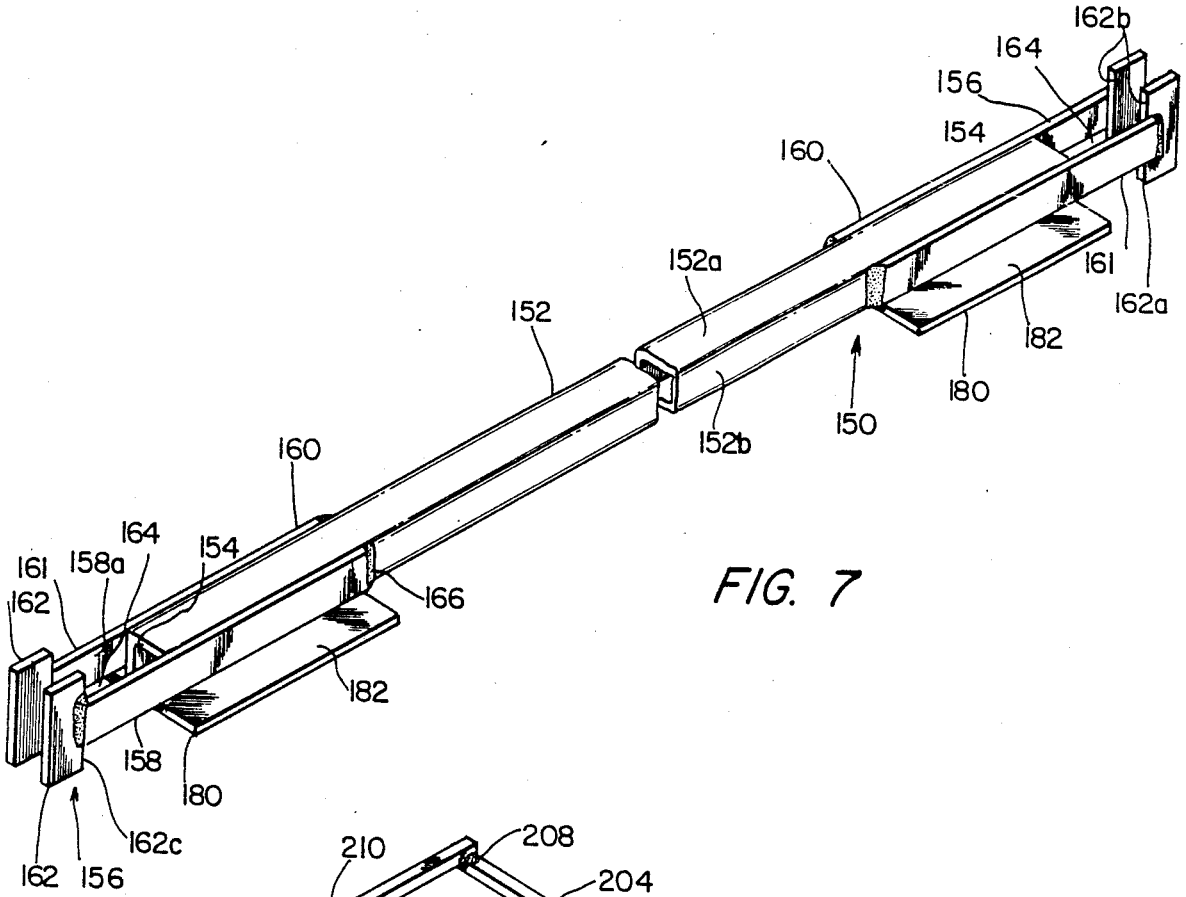
FIG. 7 is a perspective view of the hold down bar of the present invention with the mid-section cut away.

With particular reference to FIGS. 4, 5, and 7, hold-down bars 150 are illustrated both separately (FIG. 7) and in use between opposing pairs of locking rails 80 (FIGS. 4 and 5). In a preferred embodiment, there are two pairs of opposed locking rails 80 connected to the inner faces 64 of side panels 60 s that front faces **84*a* of ratchet bars 84 on opposed rails 80 face each other and are essentially parallel. In a preferred embodiment, at least one hold-down bar 150 extends between each pair of opposed locking rails 80**

Hold-down bars 150 comprise a main tube 152, which can be of square transverse cross-section, as shown, or of rectangular transverse cross-section. Tube 152 has a planar top surface **152*a* which faces upward in use, two vertical, planar side surfaces 152*b* and a planar bottom surface 152*c***. A hollow tube is preferred to a solid bar, as a tube provides greater strength and is lighter than a solid bar.

At both ends 154 of tube 152 are opposed pairs of resilient pawls 156 for engaging teeth 88 of ratchet bars 84. In a preferred embodiment, each pawl 156 comprises an arm 158 having proximal and distal ends 160 and 161. Proximal end 160 is attached to one of side surfaces **152*b* of tube 152 by a weld 166. A rectangular, longitudinally extending clamp 162 extends from distal end 161. Pawls 156 can be formed as unitary parts, or their component parts, arms 158 and clamps 162 can be formed separately and welded together. Distal ends 161 of arms 158, to which clamps 162 are attached, extend beyond ends 154 of tube 152 to define, along with clamps 162, a gap 164 having a width sufficient to fit easily around outer edges 95 of necked-in portions 92 on ratchet bars 84 without substantial flexing or bending away of arms 158 from tube 152. However, the width of gap 164 is substantially smaller than the width between side edges 100 of pairs of teeth 88; therefore, arms 158 must be flexed outward from tube 152 in order to slide over teeth 88. In a preferred embodiment, clamps 162 are attached to the inner surface 158*a* of arms 158 by welds 168** for a purpose to be described hereinafter.

Rectangular guard plates 180 ar attached to bottom surface **152*c* of tube 152 at ends 154 of tube 152 to form rectangular wings 182 extending outward from side surfaces 152*b*. Outer edges 184 of guard plates 180 can extend beyond ends 154 on tube 152 and slightly into gap 164**.

With particular reference to FIG. 5, the engagement of the hold-down bar 150 with locking rails 80 is best understood. One pair of arms 158 is shown slidably engaged with a pair of teeth 88 of ratchet bar 84. Inner surfaces **158*a* of arms 158 are pressed against side edges 100 of a pair of teeth 88 so that distal ends 161 of arms 158 are flexed in a substantially horizontal plane away from side surfaces 152*b* of tube 152. For a purpose to be described hereinafter, clamps 162 project inwardly from distal ends 161 of arms 158 so that facing edges 162*b* of clamps 162 will face and/or engage back surfaces 84*b* of ratchet bar 84 when arms 158 engage ratchet bar 84**.

Guard plate 180 is sufficiently wide to bridge gaps 186 which form between inner surfaces **158*a* of arms 158 and side surfaces 152*b* of tube 152 when distal ends 161 are contacted against upper edges 98 and side edges 100 of teeth 88. Plates 180 are at least as wide as teeth 88, so that when arms 158 engage edges 98 and 100 of teeth 88, material is blocked from entering gaps 186 between inner surfaces 158*a* of arms 158 and side surfaces 152*b* of tube 152. In this way, distal ends 161 of arms 158 can return or rebound to engage necked-in portions 92 after being flexed away from the tube 152 by edges 98 and 100 of teeth 88**.

Upper edges 98 of teeth 88 act as wedges to force arms 158 away from side surfaces **152*b* of tube 152 when downward pressure is applied upon hold-down bar 150. This allows hold-down bar 150 to move downward along the locking rail 80**.

Arms 158 resiliently return or rebound towards side surfaces **152*b* of tube 152 when arms 158 slide past side edges 100 of teeth 88 to contact necked-in portions 92 between adjacent teeth 88. Upward pressure on hold-down bar 150 causes arms 158, engaged about one of necked-in portions 92, to contact one of indentations 104 in one pair of teeth 88 immediately above, thereby preventing undesired upward movement of hold-down bar 150. Note that in a preferred embodiment, the curved shape of indentations 104 may place a torsional stress against arms 158; however, projections 106 prevent arms 158 from flexing too far away from side surfaces 152*b* of tube 152 so as to limit the amount of torsional stress on arms 158 which might result from uneven bending, and also to help prevent arms 158 from flexing far enough away from tube 152 to move upwards from necked-in portions 92 over pairs of teeth 88**.

The structure of ratchet bar 84 prevents arms 158 from sliding upwards from one of necked-in portions 92 over one of pairs of teeth 88 immediately above; specifically curved lower edges 102 and projections 106 of teeth 88 prevent arms 158 from flexing far enough from tube 152 to fit over side edges 100 of teeth 88. Thus, arms 158 can slide downward along rails 80, but upward motion is limited only to the top of whatever necked-in portion 92 is engaged by arms 158.

The interposition of clamps 162 between ratchet bars 84 and inner faces 64 of side panels 60 helps reinforce side panels 60, since the facing edges **162*a* of clamps 162 will press against back faces 84*b* of ratchet bars 84 should side panels 60 begin to buckle outward. In addition, clamps 162 can help to maintain hold-down bars 150 substantially horizontal with respect to container 50, and can help to prevent hold-down bars 150 from being disengaged from locking rails 80**.

With particular reference to FIGS. 4, 5 and 7, hold-down bars 150 are illustrated in engagement with ratchet bars 84 on opposed locking rails 80. Should one of hold-down bars 150 be tilted away from the horizontal, upper portions **162*b* of facing edges 162*a* of clamps 162 would come into contact with, and press against, back faces 84*b* of ratchet bar 84, while at the opposite end of hold-down bar 150, lower portions 162*c* of facing edges 162*a* of clamps 162 would come into contact with, and press against, back faces 84*b* of ratchet bar 84 on the opposed locking rail 80 to prevent further deviation of hold-down bar 15 from the horizontal. In a preferred embodiment, clamps 162 have a length slightly greater than the length of necked-in portions 92 so that a portion of each facing edge 162*a* of clamps 162 is always in contact with back faces 84*b* of at least one pair of teeth 88; this serves to prevent arms 158 from being disengaged from ratchet bar 84**.

Referring back to FIG. 4, and in particular to the top **80*a* of locking rails 80, an additional feature of locking rails 80 is illustrated; the uppermost pair of teeth 88*a* are shorter in length than the remaining pairs of teeth 88 in order to conserve space near the top of container 50. A small necked-in portion 92*a* projects upward from teeth 88*a* to assist in engaging hold-down bars 150 with locking rails 80. In a preferred embodiment, the vertical distance from top 80*a* of locking rails 80 to the projections 106*a* on teeth 88*a* is approximately two and one half inches (2 ½"), while the vertical distance from projections 106*a* on teeth 88*a* to projections 106 on teeth 88 immediately below is approximately five inches ("). Shortening of the uppermost pair of teeth 88*a* enables waste to be piled nearly to the top of container 50 without the compressed waste expanding out of the container or making it difficult to close lid 120. In a preferred embodiment, the bottom 80*b* of ratchet bar 84 does not have teeth, as such small portions of waste will generally not expand sufficiently to overflow out of container 50. If pairs of teeth 88 were to extend to the bottom panel 54, there would be no difference in performance, but the cost of manufacturing ratchet bars 84** may increase.

Figure 8:
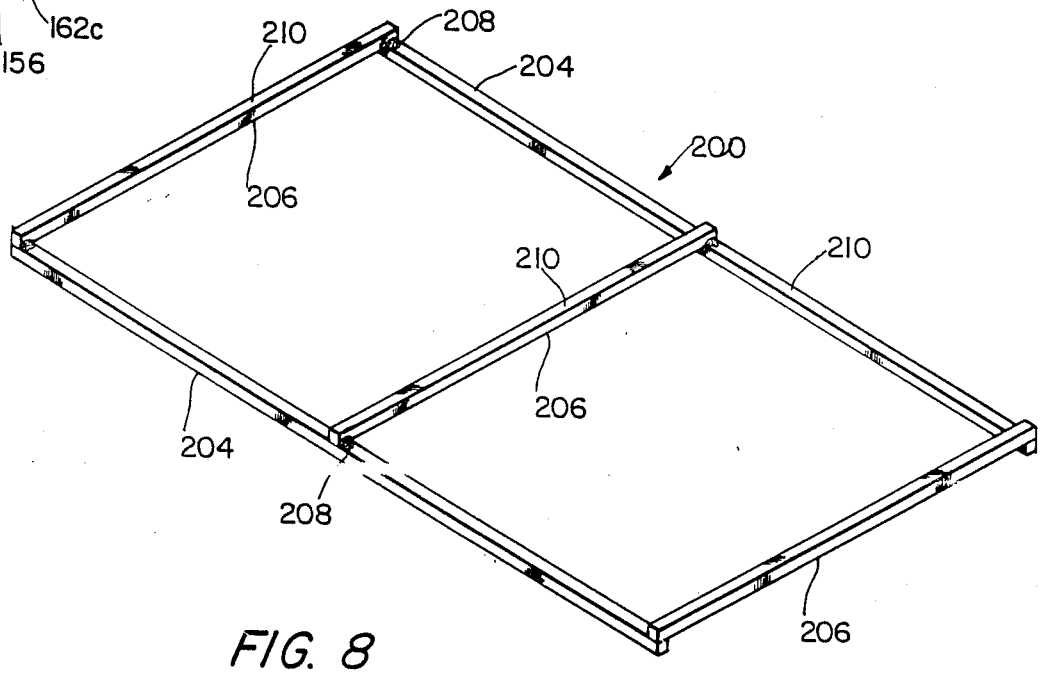
FIG. 8 is a perspective view of the rack used in the container of the present invention.

Referring again to FIG. 4, it can be seen that racks 200 are situated beneath pairs of hold-down bars 150. With further reference to FIG. 8, racks 200 are illustrated in isolation. Two parallel side bars 204 are connected by one central and two end cross bars 206 to form a rectangular frame. The upper surfaces 210 on side bars 204 are connected by welds 208 to cross bars 206. The length of cross bars 206 is substantially the same as, or less than, the distance between guard plates 180 on hold-down bars 150 so that racks 200 fit between guard plates 180.

In a preferred method of using container 50, a lower waste layer 210 is placed upon bottom panel 54 and a rack 200 placed upon the lower waste layer 210. Rack 200 is then positioned so that side bars 204 are substantially parallel to side panels 60 and cross bars 206 are substantially parallel to end panels 70. The length of side bars 204 should be less than the length of side panels 6 but greater than the distance between the locking rails 80 connected to inner faces 64 of side panels 60. A pair of hold-down bars 150 are horizontally positioned between their respective pairs of opposed locking rails 80 so that ratchet bars 84 of locking rails 80 fit into gaps 164 defined by distal ends 161 of arms 158 and clamps 162 on both ends 154 of tubes 152.

With particular reference to FIG. 5, the movement of hold-down bars 150 along ratchet bar 84 is best summarized. Downward pressure on hold-down bars 150 forces arms 158 against the wedge-shaped upper edges 98 on teeth 88, causing distal ends 161 of arms 158 to flex outward from tube 152. As distal ends 161 flex away from tube 152, the size of gap 164 expands and allows inner surfaces **158*a* of arms 158 to slide along side edges 100 of teeth 88. When hold-down bars 150 are slid past a pair of teeth 88 to necked-in portions 92, arms 158 resiliently return toward tube 152, decreasing the size of gap 164, thereby preventing hold-down bars 150 from sliding up past whatever necked-in portion 92** is presently engaged.

Referring back to FIG. 4, the use of racks 200 with hold-down bars 150 is illustrated. Downward motion of hold-down bars 150 brings lower surfaces **152*c* of tubes 152 into contact with upper surfaces 210 of bars 204 and 206 on rack 200, and drives rack 200 downward against lower waste layer 210 to help compress and maintain the compaction of lower waste layer 210. When compaction pressure is removed from hold-down bars 150, rack 200 and hold-down bars 150 help to prevent lower waste layer 210 from expanding; ratchet bar 84 prevents upward pressure, due to expansion of waste layer 210, from forcing hold-down bars 150** upward.

After a lower waste layer 210 is compacted, more waste is added on top of rack 200 and hold-down bars 150 to form an intermediate waste layer **210*a*. A second rack 200*a* is then placed upon intermediate waste layer 210*a* and a second pair of hold-down bars 150*a* are positioned between their respective locking rails 80 to press down against second rack 200*a* above the intermediate waste layer 210*a* in a similar fashion to the hold-down bar and rack combination pressing down against lower waste layer 210. In a preferred embodiment, sets are formed of two hold-down bars 150 and one rack 200 each, and three to four sets are used in each container 50**.

During compaction, large amounts of pressure are exerted against inner faces 64 of side panels 60. Side panels 60 are generally longer than end panels 70, and side panels 60 have a greater tendency to buckle outward under compaction pressure than end panels 70. Facing edges **162*a* on clamps 162 press inwardly against back faces 84*b* of ratchet bars 84 to counteract outward buckling of side panels 60**.

The choice of the correct material for making the arms 158 is critical since they require high strength and resilient flexibility. A preferred material for arms 158 is an A.I.S.I.S.A.E. Standard Carbon Steel having A.I.S.I. No. C-1018, although other materials having similar properties of strength, resilience, and flexibility can be used. A.I.S.I. No. C-1018 steel provides the correct spring tension against the side edges 100 of teeth 88 on ratchet bar 84 for good rebound, and has sufficient strength to avoid the bending or breaking off of arms 158. A three sixteenth inch (3/16") thickness is preferred for arms 158, as one quarter inch ($\frac{1}{4}$") thickness arms were found to bend under high pressure with arms having an eight inch (8") length and a width ranging from seven eighth inch to one and one quarter inch ($\frac{7}{8}$" to 1 $\frac{1}{4}$"). Thus, the thickness of the steel used to make the resilient pawl arms will depend upon the length and width of the arms. For example, a longer resilient arm may require a greater thickness and/or width in order to provide the appropriate spring tension and strength. If necessary, tube 152 can be rectangular in transverse cross-section, although such a tube may cost more than a tube with a square transverse cross-section, and takes up more space inside of the container. However, tubing having a rectangular, transverse cross-section may be needed at higher compaction pressures. In a preferred embodiment, tube 152 can be made from 11 gauge, one inch by one inch (1"×1") low carbon, electric welded 1020 steel. However, materials having similar strength properties can be used. Clamps 162 can be produced from 1020 steel as well, and other similar materials, and are generally cut from one quarter inch by three quarter inch ($\frac{1}{4}$"×$\frac{3}{4}$") hot rolled flats.

Guard plates 180 can be produced from 12 gauge, hot rolled black low carbon steel which conforms to ASTM 569, although materials having similar properties can also be used. Guard plates 18 preferably have dimensions of three inches by six inches ("×6"). Bottom panel 54, side panels 60 and end panels 70 are also preferably formed from 12 gauge steel or similar materials.

In general, the materials used in constructing the preferred embodiments of the container and hold-down mechanism described above may be substituted with other materials depending on the strength and/or resiliency requirements of the container or part being made.

With further reference to FIG. 4, it can be seen that container 50 rests upon supports 230. Supports 230 can be made of wood or any other suitable material having the necessary strength to support the weight of container 50. The ends 232 of supports 230 have lateral notches 234. Detachable clips 236 are connected into notches 234 on ends 232 and to the flanges 56*a* and 58*a* on container 50. This permits container 50 to be easily transported by forklift. Supports 230 can be dispensed with by detaching clips 236 and supports 230 from container 50 when the container reaches a final disposal point. In this fashion, the containers can be stacked with bottom panel 54 of one container resting on lid 120 of another container.

Thus, it has been found that the present invention results in a stronger container which can hold more hazardous waste in less space than previous containers and which can be tightly sealed and easily transported in an environmentally safe manner.

Although a preferred embodiment has been described and illustrated herein, it will be understood that various alterations, modifications, and substitutions will be apparent to one of skill in the art without departing from the essential spirit of the invention. The scope of the invention is accordingly defined by the following claims.

I claim:

1. A container for use with a hazardous waste compactor comprising:

a generally rectangular bottom panel having two parallel side edges and two parallel end edges, two parallel side panels extending vertically upward from said side edges of said bottom panel, each said side panel having an inner face and an outer face, two parallel end panels extending vertically upward from said end edges of said bottom panel, each said end panel having an inner face and an outer face, at least one pair of opposed locking rails, one of said locking rails being attached to said inner face of each said side panel and extending vertically along said inner face, each said locking rail having a plurality of discrete positions, at least one hold-down bar extending between said at least one pair of opposed locking rails, said at least one hold-down bar having two ends, and resilient means on each of said two ends for cooperatively engaging one of said pair of opposed locking rails for permitting only downward vertical movement of said hold-down bar between said plurality of discrete positions along said locking rails as pressure is applied on said at least one hold-down bar.

2. The container of claim 1, further comprising:

at least one rack means positioned beneath said at least one hold-down bar for preventing upward expansion of hazardous waste deposited below said at least one rack means, whereby the downward movement of said at least one hold-down bar along said opposed locking rails in said container causes downward movement of said rack means in said container.

3. The container of claim 1, wherein each said locking rail comprises ratchet means for permitting effective motion of said hold down bars only in a vertically downward direction, and each said resilient means comprises pawl means for engaging said ratchet means.

4. The container of claim 3, wherein:

said hold-down bar has two opposed sides;

each said pawl means comprises a resilient arm, each said arm having a proximal end, a distal end, and a first face, wherein one of said proximal ends is connected to each of said opposed side surfaces of said bar so that said first faces are directed toward said opposed side surfaces and said distal ends project beyond one of said ends of said bar;

each said locking rail comprises a substantially linear center beam having a front edge and a back edge, wherein said back edge engages said inner face of one of said side panels of said container;

said locking rail further comprises a ratchet bar extending from said front edge of said center beam, said ratchet bar being substantially perpendicular to said center beam;

said discrete positions along said locking rails comprise a plurality of alternating pairs of teeth and necked-in portions in said ratchet bar; and wherein said distal ends of each said pair of arms engage said ratchet bars of said opposed locking rails, whereby downward pressure on said bar causes said arms to move vertically downward along said ratchet bars.

5. The container of claim 3, wherein said resilient arms are formed of an A.I.S.I.S.A.E. standard carbon steel having A.I.S.I. Number C-1018.

6. The container of claim 1, further comprising:

guard means on said bar for preventing waste from contacting at least a portion of said resilient means.

7. The container of claim 1, further comprising:

a lid, said lid having a pair of opposed side edges and a pair of opposed end edges;

clip means on said side edges and said end edges of said lid for holding said lid on said container; and gripping means on said outer faces of said side panels and said end panels for engaging said clip means for firmly holding said lid to said panels.

8. The container of claim 7, further comprising:

support means situated beneath said bottom panel for supporting said container; and attaching means for detachably connecting said support means to said bottom panel.

9. The container of claim 3, wherein:

each of said teeth comprises a top edge, a side edge and a bottom edge, said top edges of said teeth sloping downward from said necked-in portions to define wedges on pairs of adjacent said teeth;

stop means on said bottom edges of said teeth for stopping upward movement of said arms engaged with one of said necked-in portions immediately below one of said pairs of teeth.

10. The container of claim 1, further comprising:

clamp means on said resilient means for counteracting outward buckling of said side wall panels.

* * * * *